US005936590A

United States Patent [19]

Funder

[11] Patent Number: 5,936,590

[45] Date of Patent: Aug. 10, 1999

[54] ANTENNA SYSTEM HAVING A PLURALITY OF DIPOLE ANTENNAS CONFIGURED FROM ONE PIECE OF MATERIAL

[75] Inventor: Torben Funder, Hillerod, Denmark

[73] Assignee: Radio Frequency Systems, Inc., Marlboro, N.J.

[21] Appl. No.: 08/046,240

[22] Filed: Apr. 13, 1993

[30] Foreign Application Priority Data

Apr. 15, 1992 [DK] Denmark ..... 0514/92

[51] Int. Cl.[6] ..... H01Q 9/28; H01Q 21/12

[52] U.S. Cl. ..... 343/795; 343/789; 343/812

[58] Field of Search ..... 343/789, 795, 343/812, 810, 813; H01Q 1/42, 9/28

[56] References Cited

U.S. PATENT DOCUMENTS

| | | | |
|---|---|---|---|
| 2,130,033 | 9/1938 | Scharlau | 343/813 |
| 2,163,770 | 2/1939 | Von Radinger | 343/795 |
| 2,455,403 | 12/1948 | Brown | 343/816 |
| 2,827,628 | 8/1958 | Swinehart et al. | 343/795 |
| 2,973,517 | 2/1961 | Walts | 343/795 |
| 2,978,703 | 4/1961 | Kuecken | 343/795 |
| 5,274,391 | 12/1993 | Connolly | 343/789 |
| 5,724,051 | 3/1998 | Mailandt et al. | 343/812 |

FOREIGN PATENT DOCUMENTS

| | | | |
|---|---|---|---|
| 2325704 | 12/1974 | Germany | 343/795 |

*Primary Examiner*—Donald Hajec
*Assistant Examiner*—Daniel St. Cyr
*Attorney, Agent, or Firm*—Ware, Fressola, Van Der Sluys & Adolphson LLP

[57] ABSTRACT

An antenna system comprises at least two dipole antennas (6) constituting an antenna module and is placed above and parallel with a common, artificial ground plane (5) in the form of an electrically conducting plate, for instance the bottom of a metal box (2). The dipoles (7) and the feed lines (8, 9, 10, 11) are designed as air dielectric strip-lines and are configured in one piece of a homogeneous material and extend mechanically and electrically in an uninterrupted manner from the dipoles to the antenna connector. The parts configured in one piece are produced by punching out sheet metal, and after suitable bending the parts are inserted in corresponding openings (16) in the ground plane (5).

24 Claims, 5 Drawing Sheets

ANTENNA SYSTEM HAVING A PLURALITY OF DIPOLE ANTENNAS CONFIGURED FROM ONE PIECE OF MATERIAL

TECHNICAL FIELD

The present invention relates to antenna systems and is particularly directed to base stations antennas operating within the frequency range of 450 MHz to 900 MHz.

BACKGROUND INVENTION

The invention relates to an antenna system, comprising at least tow dipole antennas constituting an antenna module and placed above and parallel to a common, artificial ground plane in the form of an electrically conducting plate, feed lines designed as waveguides with air dielectric from the dipoles to a common feeding point and where the dipoles are carried by legs which can form part of the feed lines, and a method of manufacturing an antenna module for an antenna system, where the antenna system is made up of active antennas with matching feed lines and a common ground plane.

For instance, such antennas are used as base station antennas, i.e. the antenna system is placed in a mast and is coupled to a transmitter-receiver System via a coaxial cable. The frequency range is normally in the range of 450–900 MHz, but the antenna system can also be used in other frequency ranges.

Known antenna systems of this type are built up of individual parts by welding, soldering or screwing together the antenna parts, the feed line parts, etc. In this manner an antenna with the required electrical qualities is obtained. However, the production costs are comparatively high, as all individual parts must have precise dimensions after the assembly operations due to the comparatively high frequency range for which the antenna system is to be used. Moreover, the numerous assemblies are time-consuming and require qualified and well-educated staff in the production. Besides, an antenna construction of this type does not have optimum electrical qualities, because the many assemblies cause discontinuity in the materials used resulting in varying electrical qualities at high frequencies. Consequently, assemblies made by soldering or screwing may result in various unwanted signal components in the antenna signal.

SUMMARY OF THE INVENTION

The antenna system according to the present invention has the advantage that the entire electrical signal path from a common feeding point, which for instance may be an antenna connector for the antenna cable from the transmitter-receiver, and all the way out into the antenna dipoles is uninterrupted and of a homogeneous material. In this way an ideal signal path is obtained.

Various methods, such as casting, for instance die casting, or punching out sheet metal and subsequent bending, can be applied for the production of the homogeneous antenna with feed lines etc. By manufacturing the part of an antenna module which is configured in one piece by punching out or cutting out sheet metal of electrically conducting material and that it is bent at previously defined points and secured by welding or soldering to an electrically conducting plate constituting a ground plane for the antenna, a rational production is achieved at greatly reduced production costs compared with the traditional method of manufacturing. The punching or cutting can be carried out either in one step using a punching or cutting tool corresponding to an antenna module, or by using a programmable machine tool for current or stepwise cutting or punching. The first punching method is particularly applicable for the manufacture of many identical antenna modules, whereas the latter method renders the manufacture of antennas of almost any type or size possible by controlling a programmable machine tool.

The antenna according to the invention is preferably produced in such a manner that the parts which are to be fixed to the ground plane, being a metal plate or an open sheet metal box, are constructed with areas with reduced dimensions to be placed directly in corresponding openings in the ground plane. As a result the parts are fixed, placed correctly and at a well-defined distance from the ground plane at once. The fixing is usually carried out by soldering or welding on the back of the ground plane, i.e. the side turning away from the active antenna parts. In this manner changes on the antenna side of the ground plane are avoided.

In many antenna systems it will be possible that the common feeding point is an antenna connector, so that the assembly between the antenna connector and the feed line of the antenna is the only mechanical assembly of the antenna. If the antenna system is made up of a number of antenna modules, it will be possible to couple these antenna modules with at least one additional feed line produced in the same way as the rest of the antenna, and which can either be configured in one piece with the antenna system according to the invention, or be coupled together with the antenna system in a generally known manner.

As the two arms of each dipole must be electrically isolated from each other, areas can be punched or made during the punching of the antenna parts , in which area a dielectric holder can be placed, so that the parts are placed correctly relative to each other during the fabrication of the antenna. These holders can remain in the antenna parts to continuously ensure that the parts are positioned correctly in relation to each other, so that increased mechanical stability of the antenna parts is obtained.

BRIEF DESCRIPTION OF THE DRAWINGS

In the following the invention will be explained in further detail with reference to the drawing, in which.

BEST MODE FOR CARRYING OUT THE INVENTION

Figure 1:
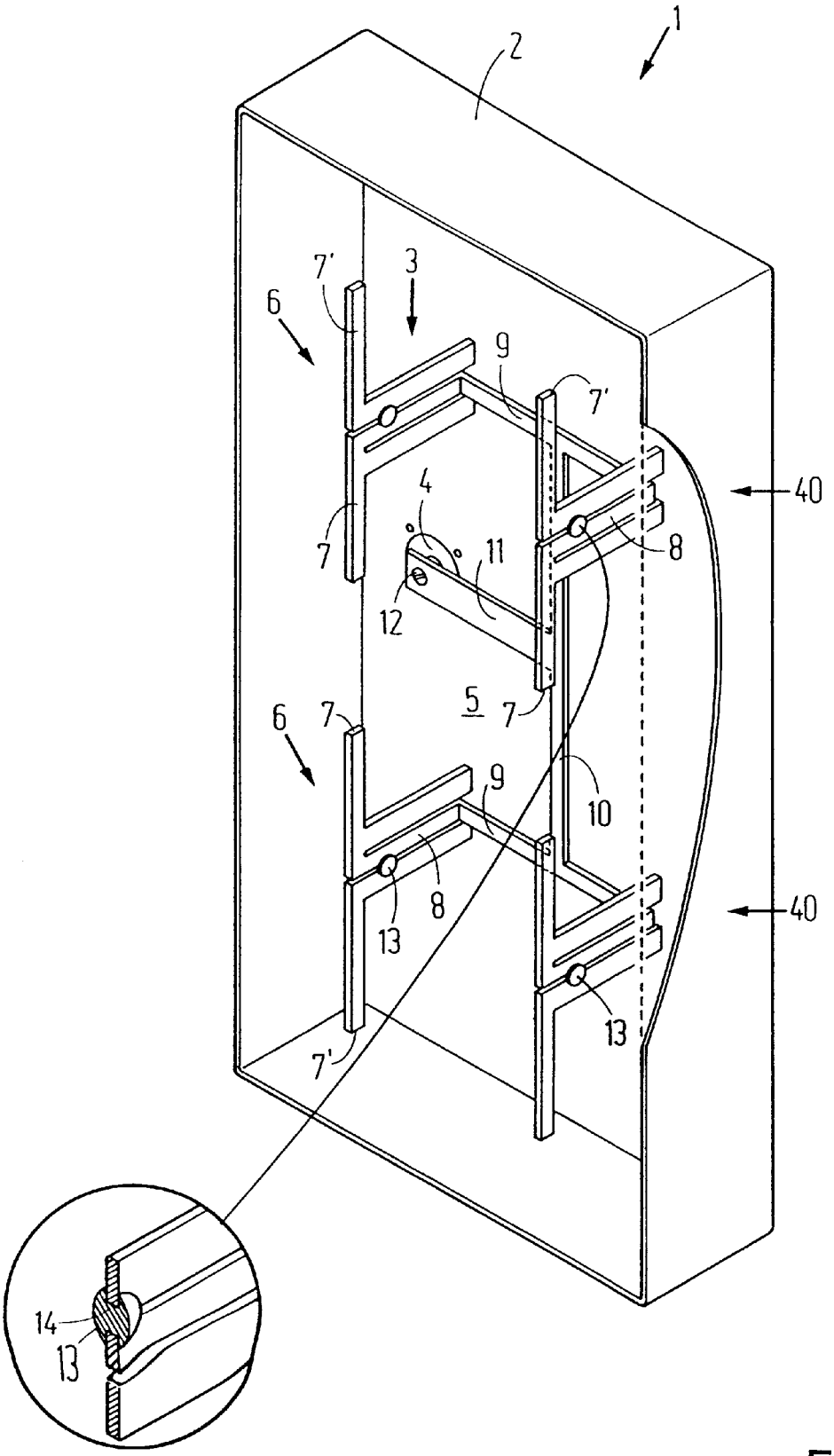
FIG. 1 shows an antenna system with two pairs of dipoles according to a first embodiment of the invention.
Figure 2:
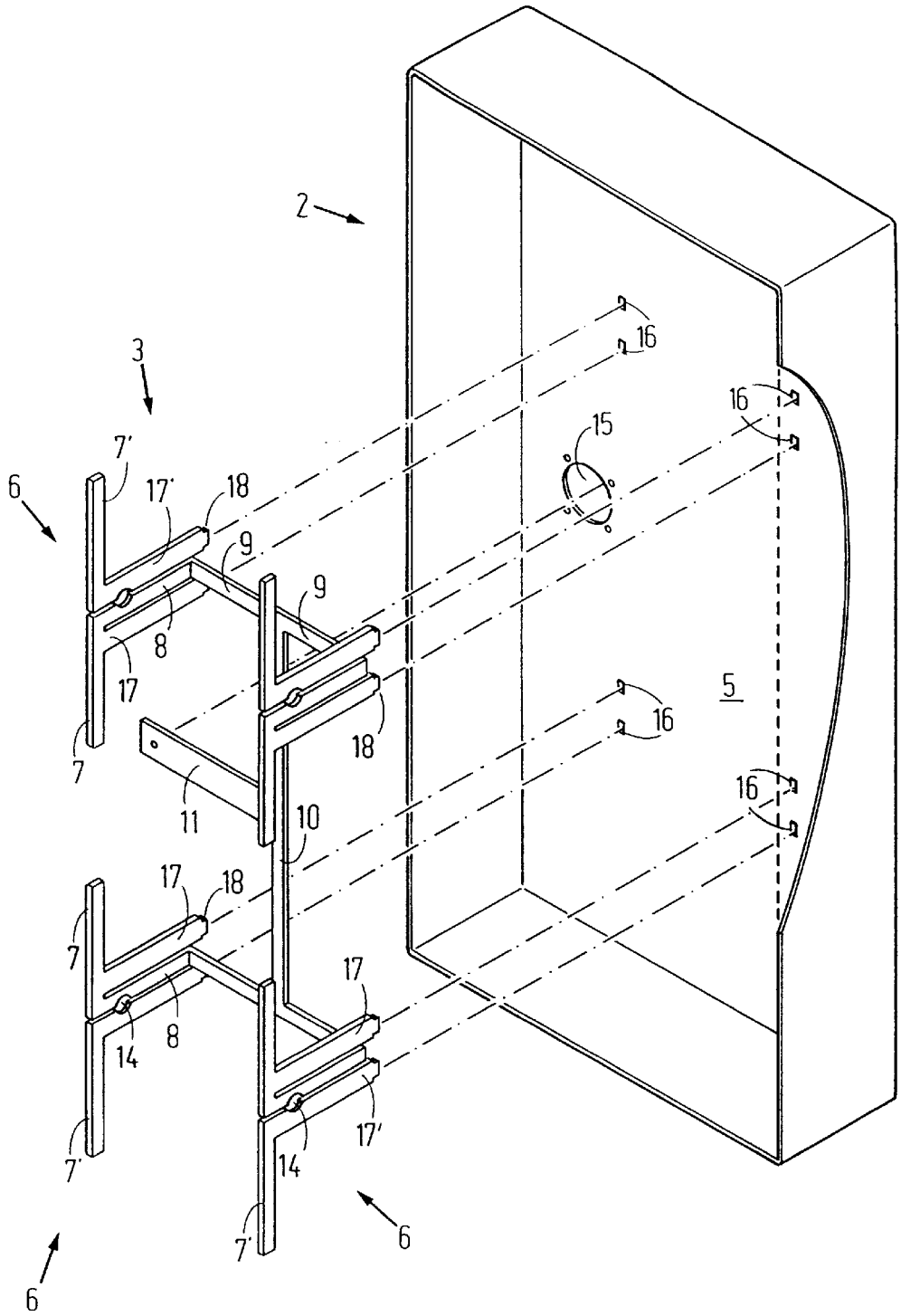
FIG 2 shows the same antenna system as in FIG. 1, but as an exploded view.

The antenna system 1 in FIGS. 1 and 2 comprises a metal box 2, the bottom 5 of which is an artificial electrical ground plane for four antennas 3 each consisting of a dipole antenna 6. The dipole antennas 6 are placed in parallel pairs opposite each other and form an antenna module 40, so that the antenna system comprises two antenna modules.

Via the feed lines 8, 9, 10, 11, which are designed as so-called "strip-line" feeders, the dipole antennas 6 are connected to a common antenna connector 4 by means of a screw 12 or a similar fixing. The antenna connector 4 is placed in an opening 15 in the ground plane 5. In the usual manner each dipole antenna is provided with two arms 7, 7' carried by legs 17 and 17', respectively.

The box 2 can be open as shown or closed with a not shown radome or the like of non-electrically conducting material, which prevents precipitation from penetrating into the antenna system and moreover reduces a possible wind-load on the antenna system.

Figure 3:
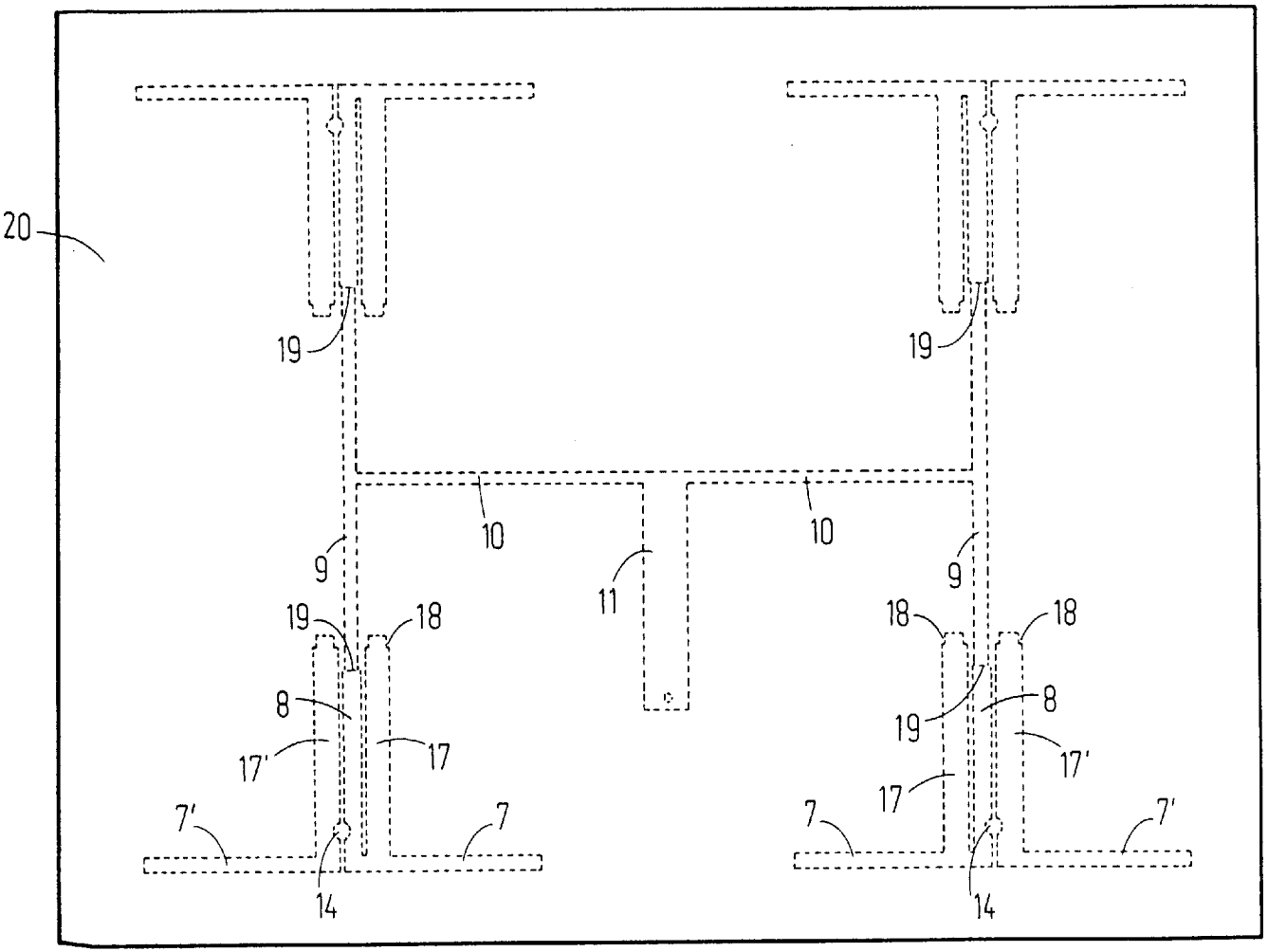
FIG. 3 shows the antenna in FIG. 1 with feed lines as a plane item before the bending and mounting operation.

The active part of the antennas including the feed lines are made as shown in FIG. 3 by punching or cutting in a plane item 20, which for instance is a 3 mm thick plate of AlMg 3 or a similar material suited for the purpose. FIG. 3 shows that after the punching or cutting operation the parts 7, 8, 9, 10, 11, 17 are configured in one piece. After appropriate bending along the bending lines 19 the active part shown in FIG. 2 appears except the dipoles 7' and the matching legs 17', which are punched or cut out separately, either as shown in FIG. 3 or of a separate plate.

In order to position the dipole arms 7 and 7' correctly relative to each other and to get the correct distance between the feed line 8 and the leg 17', appropriate punchings 14 can be made, for instance circular punchings, in which a holder 13 of a dielectric material, for instance a synthetic material, can be inserted.

In the end pointing away from the dipoles 7, 7' all the legs 17, 17' have sharp-edged cut-offs 18 with well-defined dimensions, so that this end of the antenna legs 17, 17' fits precisely into corresponding punched openings 16 in the electrical ground plane 5 constituted by the bottom of the box 2, so that the entire antenna 3 with feed lines 8 can be inserted at one time as shown in FIG. 2. The parts are fixed by welding or soldering on the back of the box 2. In this way the transmission lines 9, 10, 11 will run in a fixed well-defined distance from the ground plane 5, see FIGS. 1 and 2. By means of a screw 12 or a similar means the feed line 11 is mechanically and electrically fixed to the centre conductor of a coaxial connector 4, so that the feed line is positioned at a correct distance from the ground plane.

The box 2 comprising the ground plane 5 is made by cutting and bending a suitable metal sheet, for instance a 2 mm $AlMg_3$ plate, where the corners are welded together on the outside after bending.

Figure 4:
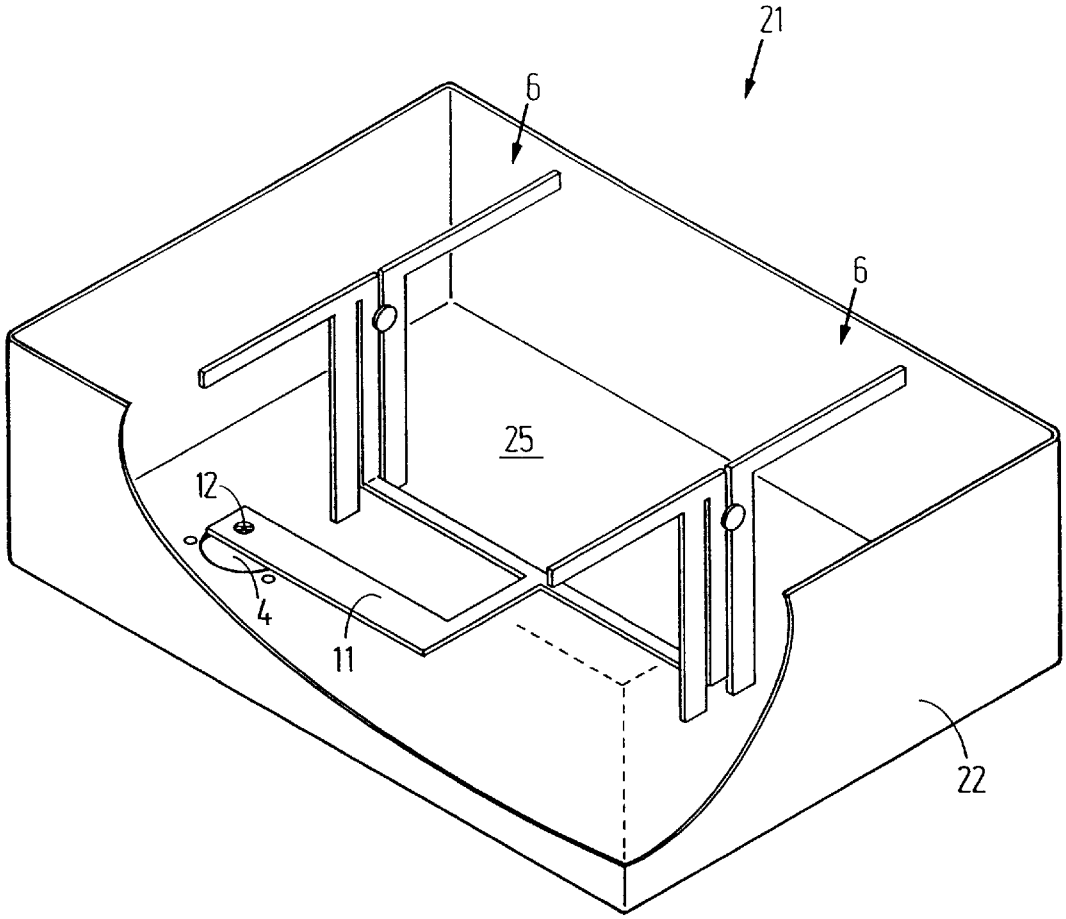
FIG. 4 shows an antenna system with one pair of dipoles according to another embodiment of the invention.

FIG. 4 shows another embodiment of an antenna system according to the invention, wherein an antenna system 21 comprising one antenna module is placed in a corresponding box 22, the bottom 25 of which constitutes the electrical ground plane.

Figure 5:
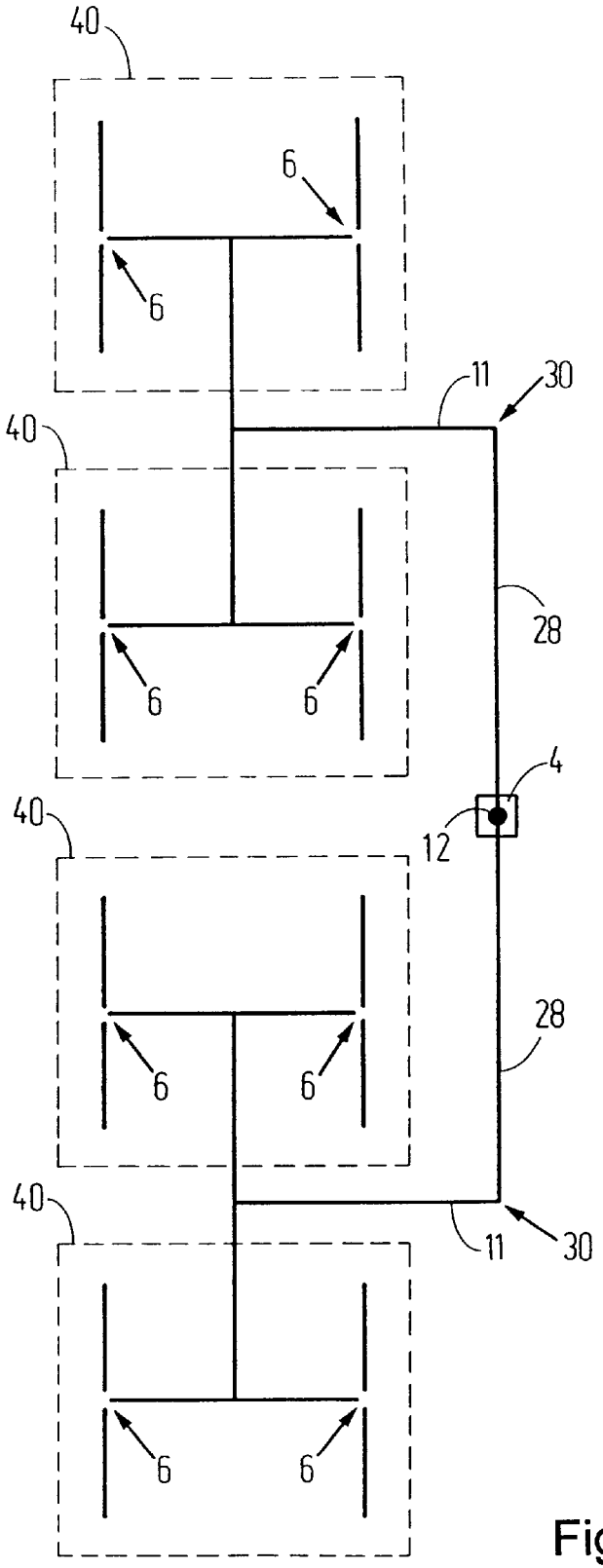
FIG. 5 shows in principle how an antenna system with four pairs of dipoles (antenna modules) can be fabricated according to the invention.

FIG. 5 shows in principle how four antenna modules 40 are coupled together in a not shown box on a not shown ground plane. The antenna modules are coupled together in pairs and the common feed line 11 extending from there is coupled to the antenna connector 4 via an additional feed line 28. As explained previously the parts can be configured in one piece, but the additional feed line 28 can also be coupled together with the feed lines 11 at the marked corner assemblies 30. In the same way antennas with any number of modules can be built up applying the above design and method.

The antennas and feed lines shown in the drawings are simply examples of embodiments of the invention. It will be obvious to a person skilled in the art that both the active antennas and the feed lines as well as possible antenna legs can be designed in numerous other ways without deviating from the basic antenna construction and the method of manufacture according to the invention.

I claim:

1. An antenna system comprising at least two dipole antennas (6) constituting an antenna module (40) and placed above and parallel to a common, artificial ground plane (5) in the form of an electrically conducting plate, feed lines (8, 9, 10, 11) designed as waveguides with air dielectric from the dipole antennas to a common feeding point (4) and where the dipole antennas each have a pair of dipole arms which are carried by matching legs (17) which form part of the feed lines, characterized in that the feed lines from each dipole antenna (6) to the common point (4) and at least one dipole arm (7) in each dipole antenna and a matching leg (17) are configured mechanically and electrically in one piece of a homogeneous material.

2. An antenna system according to claim 1, characterized in that the matching leg (17, 17') of each dipole arm has an area (18) with reduced width or thickness in a terminal end pointing away from the dipole arm.

3. An antenna system according to claim 2, characterized in that the ground plane (5, 25) is the bottom of a box (2, 22) of an electrically conducting material and where a side opposite the bottom is of a non-electrically conducting material and where through-going openings (16) are provided in the ground plane corresponding to the reduced width or thickness of the matching legs (17, 17').

4. An antenna system according to claim 3, characterized in that at least one of the matching legs (17') in each dipole antenna (6) is positioned and fixed in relation to the feed line (8) by means of at least one holder (14) of dielectric material.

5. An antenna system according to claim 4, characterized in that it comprises a number of antenna modules (40) configured in one piece and coupled together by means of at least one additional feed line (28) and is placed in a common ground plane.

6. An antenna system according to claim 2, characterized in that at least one of the matching legs (17') in each dipole antenna (6) is positioned and fixed in relation to the feed line (8) by means of at least one holder (14) of dielectric material.

7. An antenna system according to claim 3, characterized in that it comprises a number of antenna modules (40) configured in one piece and coupled together by means of at least one additional feed line (28) and is placed in a common ground plane.

8. An antenna system according to claim 2, characterized in that it comprises a number of antenna modules (40) configured in one piece and coupled together by means of at least one additional feed line (28) and is placed in a common ground plane.

9. An antenna system according to claim 2, characterized in that the ground plane (5, 25) is the bottom of a box (2, 22) of an electrically conducting material and where a side opposite the bottom is open and where through-going openings (16) are provided in the ground plane corresponding to the reduced width or thickness of the matching legs (17, 17').

10. An antenna system according to claim 9, characterized in that at least one of the matching legs (17') in each dipole antenna (6) is positioned and fixed in relation to the feed line (8) by means of at least one holder (14) of dielectric material.

11. An antenna system according to claim 10, characterized in that it comprises a number of antenna modules (40) configured in one piece and coupled together by means of at least one additional feed line (28) and is placed in a common ground plane.

12. An antenna system according to claim 9, characterized in that it comprises a number of antenna modules (40)

configured in one piece and coupled together by means of at least one additional feed line (28) and is placed in a common ground plane.

13. An antenna system according to claim 1, characterized in that the common feeding point is an antenna connector (4), to which a feed line is secured both mechanically and electrically.

14. An antenna system according to claim 1, characterized in that at least one of the matching legs (17') in each dipole antenna (6) is positioned and fixed in relation to the feed line (8) by means of at least one holder (14) of dielectric material.

15. An antenna system according to claim 1, characterized in that it comprises a number of antenna modules (40) configured in one piece and coupled together by means of at least one additional feed line (28) and is placed in a common ground plane.

16. A method of manufacturing an antenna module for an antenna system according to claim 1, where the antenna system is made of active antennas with matching feed lines and a common around plane, the method being characterized in that the feed lines from each dipole antenna (6) to the common point (4), said at least one dipole arm (7) in each dipole antenna and said matching leg (17) which are configured mechanically and electrically in one piece of a homogeneous material are punched out or cut out of sheet metal of electrically conducting material and that said sheet metal is bent in previously defined points and secured by welding or soldering to said electrically conducting plate constituting said ground plane for the antenna.

17. A method according to claim 16, characterized in that also the parts which are not configured in one piece with other rest of the antenna module are punched or cut out of sheet metal and are secured to the ground plane by welding or soldering.

18. A method according to claim 17, characterized in that apertures (16) are made in the ground plane, that the matching leg of each dipole arm is punched or cut out in such a manner that there are areas (18) with reduced width or thickness corresponding to the apertures, and that the soldering or the welding is made on the back of the ground plane.

19. A method according to claim 18, characterized in that during the punching or cutting out of the antenna parts, areas (14) are formed in parts which are to be positioned in relation to each other and that holders (13) are inserted in these areas.

20. A method according to claim 17, characterized in that during the punching or cutting out of the antenna parts, areas (14) are formed in parts which are to be positioned in relation to each other and that holders (13) are inserted in these areas.

21. A method according to claim 18, characterized in that said apertures are square.

22. A method according to claim 21, characterized in that said holders are inserted in said areas before the parts are secured to the ground plane.

23. A method according to claim 16, characterized in that apertures (16) are made in the ground plane, that the matching leg of each dipole arm is punched or cut out in such a manner that there are areas (18) with reduced width or thickness corresponding to the aperture and that the soldering or the welding is made on the back of the ground plane.

24. A method according to claim 16, characterized in that during the punching or cutting out of the antenna parts, areas (14) are formed in parts which are to be positioned in relation to each other and that holders (13) are inserted in these areas.

* * * * *

UNITED STATES PATENT AND TRADEMARK OFFICE

CERTIFICATE OF CORRECTION

PATENT NO. : 5,936,590
DATED : August 10, 1999
INVENTOR(S) : Torbun Funder

It is certified that error appears in the above-identified patent and that said Letters Patent is hereby corrected as shown below:

Title page,
Item [56], References Cited, "2/1939 Von Radinger" should be -- 2/1936 Von Radinger --, and "8/1958 Swinehart" should be -- 8/1953 --.
FOREIGN PATENT DOCUMENTS, please add -- 9104722 4/18/91 Germany --.

Column 5,
Line 20, after "made", please insert -- up --.
Line 21, "around" should be -- ground --.
Line 32, "the parts" should be -- other parts --.

Signed and Sealed this

Eleventh Day of June, 2002

*Attest:*

*Attesting Officer*

JAMES E. ROGAN
*Director of the United States Patent and Trademark Office*